United States Patent [19]

Sollog

[11] Patent Number: 4,466,510

[45] Date of Patent: Aug. 21, 1984

[54] AUTOMATIC FLOOR-LEVELING MEANS FOR A CABLE-SUSPENDED ELEVATOR

[75] Inventor: Fred N. Sollog, Franklin Square, N.Y.

[73] Assignee: Staley Development Corporation, Long Island City, N.Y.

[21] Appl. No.: 360,488

[22] Filed: Mar. 22, 1982

[51] Int. Cl.[3] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 1,315,600 | 9/1919 | Furlow | 187/29 F |
| 1,669,184 | 5/1928 | Baker | 187/29 F |
| 1,682,209 | 8/1928 | Baker | 187/29 F |

*Primary Examiner*—J. V. Truhe

*Assistant Examiner*—W. E. Duncanson, Jr.

*Attorney, Agent, or Firm*—Hopgood, Calimafde, Kalil, Blaustein & Judlowe

[57] ABSTRACT

The invention contemplates incorporation of a vertically guided jack-driven mechanism at the point of suspension-cable connection to an elevator car, the jack and all means for control thereof being carried by the elevator car, so that floor-leveling trim adjustment of car floor to landing level can be performed independent of the cable suspension and while the cable-sheave drive motor of the hoist system is at rest. Floor-leveling jack operation is fast and may be initiated upon hoist-system delivery of the car to the approximate level of a destination landing, and the jack may be reset while the hoist system is in operation to deliver the car to the approximate level of a different destination landing.

6 Claims, 5 Drawing Figures

AUTOMATIC FLOOR-LEVELING MEANS FOR A CABLE-SUSPENDED ELEVATOR

BACKGROUND OF THE INVENTION

The invention relates to floor-leveling mechanism for a cable-suspension elevator system, wherein an elevator cage and its counterweighting are cable-connected and suspended over a drive sheave at the top of an elevator shaft.

In a typical elevator system of the character indicated, say for a fully automatic 2000-lb. capacity elevator having a traveling speed of 100 feet per minute, the hoist engine for driving the drive sheave may consist of 7.5-horsepower electric motor, a worm reduction-gear unit, and an elevator-brake assembly wherein brake action is mechanically applied and power-released. Vertical rails guide the elevator cage, and plural counterweights are suspended by four steel traction cables, one end of each cable being secured to the crosshead of the cage, and the opposite ends being secured to the counterweights. These four cables pass over the traction sheave of the hoist engine and rest in traction grooves. Control may be of an automatic selective collective pushbutton type, and floor-leveling involves drive-motor and/or brake actuation at the hoist engine, as dictated by level-detection at the particular selected landing level.

A variety of leveling-control systems exists, with various degrees of sophistication in regard to precision of landing-level detection and motor/brake action in response to such detection. However, such approaches to the problem necessarily involve varying degrees of cable-stretch effects, depending upon instantaneous cage load and upon the instantaneous length of the cable suspension, from sheave to cage. Necessarily also, any given automatic positioning involves multiple and varied operations of the drive motor and/or brake mechanism, which operations are of vastly different nature from the primary raising and lowering functions of the hoist engine. Moreover, the precision requirements of floor-leveling to meet specifications for the safety of handicapped persons impose severe demands on the complexity and sophistication of the hoist engine and its control.

BRIEF STATEMENT OF THE INVENTION

It is an object of the invention to provide an improved floor-leveling mechanism for an elevator of the character indicated.

It is a specific object to provide such floor-leveling mechanism mechanically independent of the hoist engine and as an integral component feature of the cage itself.

It is another specific object to meet more strict floor-leveling requirements, as for accommodation of handicapped persons, without imposing additional functions or complexity upon hoist-engine components or control in a cable-suspended elevator system.

A further specific object is to provide a system of upgraded floor-leveling control for an existing elevator installation, with substantially zero change of the hoist engine and with simplification of its control.

A general object is to meet the above objects with minimum cost, greater reliability, and simpler maintenance, as compared to existing elevator systems.

The invention achieves the foregoing objects and other features by incorporating a vertically guided jack-driven mechanism at the point of suspension-cable connection to an elevator cage, the jack being operative over a range of otherwise lost-motion connection of the cable to the cage. The jack and all means of its control are carried by the elevator cage, so that floor-leveling trim adjustment of cage floor to landing level can be performed independent of the cable suspension and while the hoist engine is at rest. Floor-leveling jack operation is fast and may be initiated upon hoist-engine delivery of the cage to the approximate level of a destination landing, and the jack may be reset while the hoist engine is in operation to deliver the cage to the approximate level of a different destination landing. Various systems and modes of jack operation are described.

DETAILED DESCRIPTION OF THE INVENTION

The invention will be illustratively described in detail for preferred embodiments, in conjunction with the accompanying drawings, in which.

Figure 1:
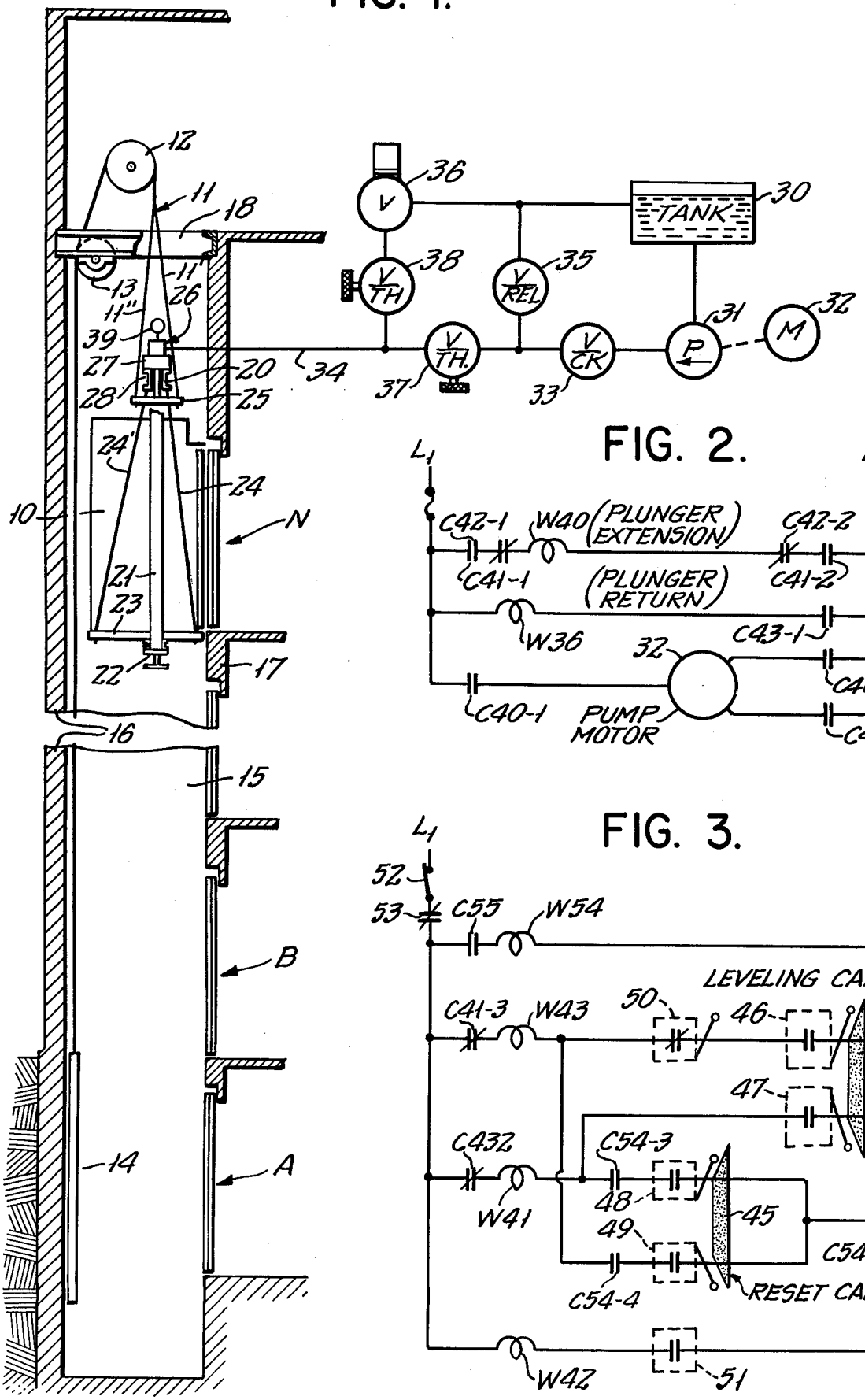
FIG. 1 is a simplified fragmentary view in elevation of an elevator system incorporating the invention, certain floor-leveling control components being schematically shown.

In FIG. 1, an elevator car 10 is shown to be suspended by cable means 11, from a hoist comprising traction sheaves 12, the latter being driven by an electric motor via reduction-gear coupling (not shown). Idler sheaves 13 determine the offset alignment for counterweights 14 at the other end of cable means 11. Vertical rails (not shown) will be understood to guide car 10 in its vertical travel within a building shaftway 15, shown between an outer structural wall 16 of the building and an interior wall 17, and the latter has door openings at each of a plurality of floor levels A, B . . . N in the building. At the top of the shaftway, structural beams, as at 18, provide a fixed base for mounting the hoist motor and the two sets of sheaves 12–13. The system of call buttons at particular floor levels A, B . . . N and destination buttons within car 10, together with a suitably responsive controller for determining direction and duration of car-positioning motor drive via the drive-sheave means 12, may be conventional and therefore need not be further described. Also conventional, and therefore neither shown nor described herein, are the floor-leveling and braking system operative upon the hoist motor and/or sheaves 12 to achieve a degree of landing conformance, of car-floor level with building-floor level, at the desired floor (landing) to be served.

The elevator car 10 may also be conventional and is shown to rely upon and to be contained within a suspension cage comprising an upper horizontal crosshead 20, vertical channel members 21 rigidly suspended from the ends of the crosshead, and a lower horizontal beam 22 rigidly connecting the lower ends of channel members 21. The floor 23 of car 10 is securely supported upon the lower horizontal beam 22, and front and rear braces 24–24', referenced to the respective ends of crosshead 20, stabilize floor 23 against tilt at the respective lateral sides of the car.

It is conventional to suspend car 10 via a hitch plate 25 centered along crosshead 20 and directly abutted to the underside of crosshead 20, and in the case of four suspension cables 11, they are respectively connected to four equally spaced points of supporting connection to the hitch plate 25; for the aspect of FIG. 1, two of these cables will be understood to align forwardly of the crosshead, while the other two align rearwardly of the crosshead, being respectively designated 11' and 11".

In accordance with the invention, means such as a vertically operative hydraulic jack 26 is interposed between crosshead 20 and the hitch plate 25, and jack-operating means carried by and operative within car 10 determines the extent to which jack 26 is to be operated, in response to car-borne detection of landing-level, in order to achieve the final set of car-floor landing level, the jack operation being upon braking of the traction-sheave drive at a given landing level. The achievement of ultimate floor level is thus always subject to a possible precision-trim adjustment by car-borne mechanism, once the cable-drive system has halted and has been braked.

In the illustrative case of a hydraulically operated jack 26, the latter may comprise a cylinder body 27 secured atop crosshead 20, and a vertically downward piston or plunger 28 slidable in body 27 and abutting the hitch plate 25. Thus, depending upon the extent of hydraulic actuation of plunger 28, car 10 will have been jacked upward with respect to the instantaneous horizontal plane of cable support of hitch plate 25. In FIG. 1, there is a schematic indication of hydraulic control means, all carried by car 10, to determine hydraulic actuation of plunger 28, namely, a reservoir tank 30 for hydraulic fluid, a pump 31 and its electric-drive motor 32, and a check valve 33 in the pump-outlet line 34 of connection to the cylinder-head region of jack 26. A relief valve 35 connects line 34 to tank 30, to assure a pressure limit of hydraulic-fluid delivery, and a normally closed solenoid-operable valve 36 enables operating pressure fluid in line 34 to be bled to tank 30, to achieve a return of hitch plate 25 in the direction of crosshead 20 (i.e., an electrically controlled limited gravitational descent of the car with respect to the currently braked elevation of the hitch plate). A first manually adjustable throttle valve 37 determines a limiting flow rate at which pressure fluid can be supplied to the jack cylinder 27, and a second manually adjustable throttle valve 38 similarly determines a limiting flow rate at which fluid in cylinder 27 can be returned to tank 30, in the event of an actuated opening of solenoid valve 36.

Finally, in terms of components shown in FIG. 1, a low-pressure switch 39 is connected for constant monitoring of cylinder pressure in jack 26, to the end that, should such pressure fall below a predetermined lower limit (e.g., a lower limit of pressure less than enough to jack crosshead 20 from contact with hitch plate 25), then suitable indication of the fact can, inter alia, be remotely given; illustratively, the contacts of switch 39 are closed for pressures in line 34 above said predetermined lower limit.

Figure 2:
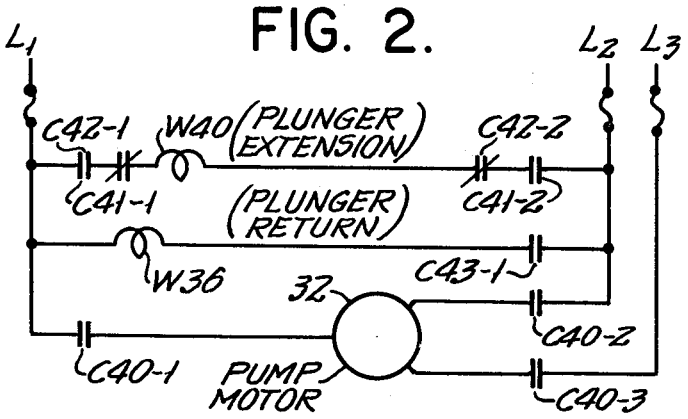
FIG. 2 is an electrical ladder diagram showing hydraulic-pump connections used in the system of FIG. 1.
Figure 3:
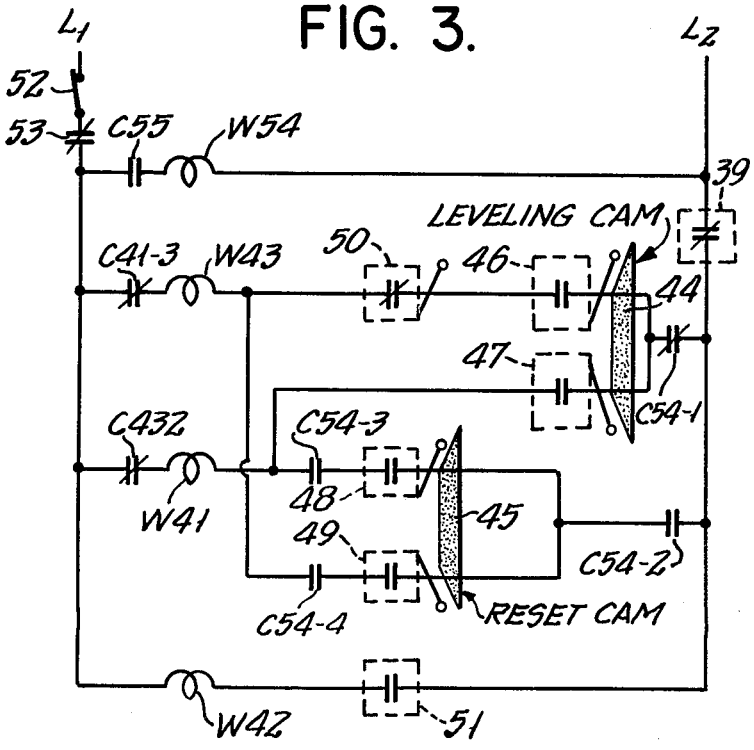
FIG. 3 is another ladder diagram schematicaly showing control features for a preferred mode of FIG. 1 operation.

For further detail, reference is now made to FIGS. 2 and 3, respectively showing pump-motor and solenoid-valve control means, and electrical control connections, involved in the floor-leveling system of FIG. 1. In the control arrangements of FIGS. 2 and 3, a conventional 3-wire a-c voltage supply comprises lines $L_1$, $L_2$, $L_3$; the voltage across lines $L_1$–$L_2$ is used for relay and solenoid operation, while all three lines $L_1$–$L_2$–$L_3$ provide voltage to dirve the hydraulic-pump motor 32. A pump-motor relay 40 has its winding W40 interlocked with operation of plunger drive and stop contacts C41 and C42 (of further relay windings W41 and W42, respectively, see FIG. 3), and separate normally-open contacts C40-1, C40-2 and C40-3 of relay 40 are in the respective line connections to motor 32.

Operation of pump motor 32 is involved only when and to the extent needed to jack crosshead 20 upward from the hitch plate 25 (i.e., to extend plunger 28 downward, in the direction away from jack cylinder 27); while operation of solenoid valve 36 is involved only when and to the extent needed to allow car weight to cause incremental approach of crosshead 20 downward toward hitch plate 25 (i.e., to withdraw plunger 28 upward, in the direction into jack cylinder 27). For convenience therefore, the legend "Plunger Extension" has been applied to FIG. 3 adjacent the excitation line for the pump-motor relay winding W40, and the legend "Plunger Return" has been applied adjacent the excitation line for the winding W36 of solenoid valve 36. The description of FIG. 2 is completed by identifying the winding W36 of solenoid valve 36 and its connection such that solenoid excitation is subject to excitation of another relay winding W43 having normally open contacts C43-1 in series with winding W36.

The ladder diagram of FIG. 3 deals with control circuitry for the ascent-trim function (pump motor 32) or for the descent-trim function (solenoid-valve 36) of FIG. 2. And this control circuitry relies upon limit-switch reaction to each of two control cams 44–45. The control cam 44 will be understood to be a precision floor-leveling cam, there being one such cam 44 fixed at each of the different destination floor levels at landings A, B . . . N; cam 44 is characterized by a vertical land surface between oppositely sloped upper and lower end surfaces, and the cam-following arms of upper and lower car-mounted limit switches 46–47 (each with normally open contacts) are poised for coaction with a given cam 44. The single control cam 45 is of similar nature but is fixed to the externally exposed surface of plunger 28, being used for limit-switch determination of a plunger-centered position, in the course of car travel to a new destination landing; cam 45 is thus also characterized by a vertical land surface between opposite sloped upper and lower end surfaces, and the cam-following arms of upper and lower car-mounted limit switches 48–49 (each with normally open contacts) are poised for coaction with the single cam 45.

In the absence of sufficiently precise registration of car floor 23 with a given landing level, one or the other of limit switches 46–47 will have been actuated (to the point of closing its contacts), but within a region of sufficient precision of such registration, both limit switches 46–47 will be in their unactuated (normally open contacts) state; typically, commercially available limit-switch components are able to achieve such precision within the range of ±0.25 inch, meaning that such precision of floor-level trim can be assured with no difficulty.

In similar fashion, the positioning of limit switches 48–49 with respect to the vertical center of travel of plunger 28 can cause the actuation of one or the other of switches 48–49 unless and until plunger 28 is in its vertically central position. The range of vertical travel of plunger 28 is selected to safely exceed the floor-leveling capability of a given elevator hoist system; for example, if a given hoist system has the ability to position car 10 within ±2 inches of a desired landing level, then plunger 28 should be selected for a total travel capability which is at least 4 inches and which preferably has such greater travel capability (e.g., six inches) as to enable a one-inch safety overlap of the ±2-inch capability of the hoist system. Thus, in this illustration, plunger 28 should have a ±3-inch capability in reference to the vertically central plunger position determined when neither of limit switches 48–49 is actuated. In the case of FIG. 3, this plunger-displacement capability exists between an upper or retraction limit determined by a car-mounted limit switch 50 having normally closed contacts and a lower or extension limit determined by a car-mounted limit switch 51 having normally closed contacts; limit switches 50–51 may be mounted respectively above and adjacent switch 48, and below and adjacent switch 49, and aligned for coaction with cam 45, as will be understood.

To complete the identification of the car-borne components of FIG. 3, a normally closed disconnect switch 52 and a normally closed "emergency stop" switch 53 are provided in series with all automatic trim controls. And the winding W54 of a car-in-motion relay is excited via normally open pilot contacts C55 of a controller relay (not shown, but to be understood as part of conventional control means for hoist-system displacement of car 10). The car-in-motion relay has first normally closed contacts C54-1 in series with branch lines which respectively involve the floor-trim limit switches 46–47, second normally open contacts C54-2 in series with branch lines which respectively involve the plunger-centering limit switches 48–49, third normally open contacts C54-3 in the branch line of limit switch 48, and fourth normally open contacts C54-4 in branch line of limit switch 49, the contacts C54-3 and C54-4 being on the line ($L_1$) side of switches 48–49 (respectively) opposed to the line ($L_2$) side of contacts C54-2.

In operation, and assuming car 10 is ascending or descending under hoist-system control, the hoist system will shut off, within its ability to deliver the car at the desired landing, and this event will be signalled to the circuits of FIGS. 2 and 3, by an opening of pilot-relay contacts C55 which track operation of the main hoist-engine controller, it being understood that contacts C55 will have been closed (to energize car-in-motion-relay winding W54) as long as the car is in motion by reason of hoist-engine operation. Having opened contacts C55, the car-in-motion-relay winding W54 will be de-energized, placing its associated contacts C54 in their normal conditions shown in FIG. 2. This being the case, open contacts C54-2 effectively lock out any chance of plunger-centering action (plunger-centering having occurred during the most-recent hoist-engine displacement of the car), but a circuit is completed to energize either the trim-up relay winding W41 or the trim-down relay winding W43, depending upon whether or which one of limit switches 47–46 has been actuated by leveling cam 44. If the trim-up winding W41 is energized, contacts C41-1 and C41-2 will close, to excite the pump-motor relay winding W40, causing its contacts C40-1, -2, -3 to close, for pump operation; plunger 28 will thus be caused to extend and to jack car 10 with respect to hitch plate 25, until the arm of limit switch 47 runs off cam 44, at which point the car floor 23 has been incrementally elevated and has achieved its desired precision of landing level. If the trim-down winding W43 is energized, contacts C43-1 will close, to excite the winding W36 of solenoid valve 36, causing hydraulic fluid to bleed from jack 26 to the reservoir tank 30; plunger 28 will thus be caused to withdraw (return) under prevailing gravitational force of car 10, allowing the car to descend until the arm of limit switch 46 runs off cam 44, at which point the car floor 23 has incrementally descended and has achieved its desired precision of landing level.

Having achieved the desired precision of landing level, the car and applicable-landing doors may be opened by conventional means (not shown); and unless cable stretch due to load change warrants releveling, no further change will occur until the doors close and the hoist system is again activated for a different landing destination. When the hoist-engine is thus again operative, pilot contacts again close, to pick up the car-in-motion relay, causing contacts C54-1 to open and thus lock out any floor-trim operation, while closing contacts C54-2, -3, -4 to recenter plunger 28, should that be necessary. Any such recentering operation will be understood to be quickly accomplished in the interval while the car is in hoist-system motion; in this interval, pump motor 32 will be driven via the winding W41 and contacts of the upleveling relay should limit switch 48 make it necessary for plunger 28 to be extended to reach its centered position, and the solenoid valve 36 will be opened via winding W43 and contact of the down-leveling relay should limit switch 49 make it necessary for plunger to be withdrawn (returned) to reach its centered position.

The described trim-positioning cycle is capable of repetition at each landing and will not operate unless the hoist system fails to deliver the car floor with sufficient ultimate precision with respect to the applicable landing.

Figure 4:
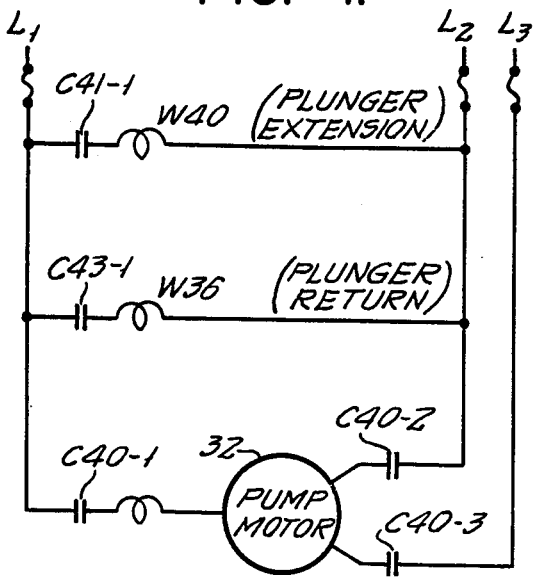
FIGS. 4 and 5 are diagrams similar to FIGS. 2 and 3, respectively, to illustrate another mode.
Figure 5:
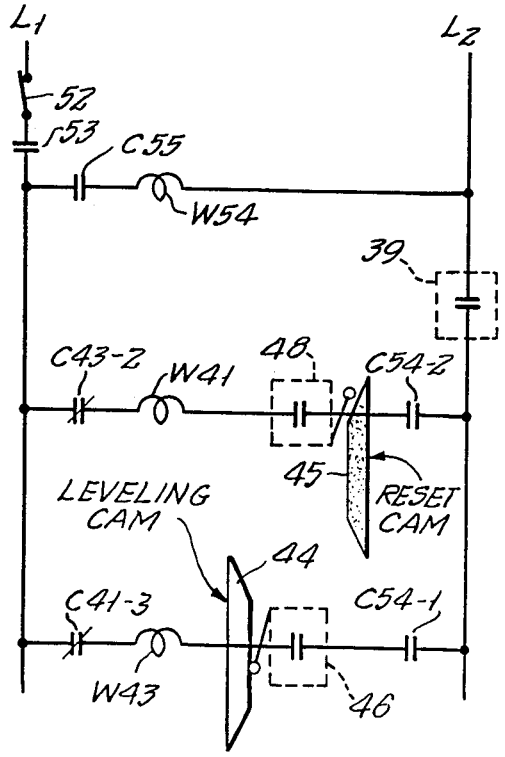

The circuits of FIGS. 4 and 5 correspond respectively to those of FIGS. 2 and 3 but serve to illustrate a different mode of using the apparatus of FIG. 1 to achieve desired ultimate precision of car-floor level at any given landing. Corresponding components have therefore been given the same identifying numbers and need not be redescribed. It suffices to point out that the mode of landing-trim operation in FIGS. 4 and 5 contemplates that plunger 28 will always have been positioned at its most-extended extreme during the most recent interval of hoist-system displacement of car 10, and that the floor-level positioning apparatus of hoist-system control will always deliver the car floor 23 to a level intentionally above each landing level, e.g., in the range of 1 to 5 inches above each landing level. In that circumstance, when hoist-system shut-down gives the signal via opening of contacts C55 that car 10 is now within the desired region above a given landing, the arm of down-leveling limit switch 46 will have been actuated by cam 44, to close switch 46 and thus excite the relay winding W43 calling for solenoid valve (36) operation and gravitational descent of the car. When the arm of switch 46 runs off cam 44, the desired floor-level precision will have been achieved, and solenoid valve 36 will close in response to switch (46) opening, thus holding the trimmed car-floor (23) level. On the other hand, when the hoist system is again activated to displace car 10 to another landing, the winding W54 of the car-in-motion relay will again be excited, causing closed contacts of limit switch 48 to excite winding W41 of the up-leveling relay, thus driving pump motor 32 until the arm of switch 48 runs off reset cam 45, to complete the reset (fully extended repositioning) of plunger 28, in readiness for another such trim cycle of operation upon hoist-system shut-down at the currently ordered destination landing.

It will be seen that the described car-borne elevator-trim apparatus meets all stated objects with simplicity, economy and availability of all components. At the same time, the way has been shown to achieve any desired degree of ultimate precision in floor-leveling control, without imposing on the existing hoist system of an installed elevator, and without requiring extreme precision in the hoist system of a new elevator. The invention is applicable regardless of the number of landings to be served in any given installation, and it also provides the basis for simple precision up-grading of existing systems without unduly interfering with such landing-level controls as may have long been part of the existing systems.

While the invention has been described in detail for the preferred forms shown, it will be understood that modificatons may be made without departing from the scope of the invention.

What is claimed is:

1. In an elevator system for a multi-level structure (a) wherein an elevator cage having an upper transverse beam is cable-suspended via a hitch plate under said beam and is counterweighted over a drive sheave, (b) wherein a car is fixedly carried by and within said cage, and (c) wherein motor drive to the sheave includes a control to determine a stopping of the elevator cage at a particular floor, the improvement in which an automatic floor-leveling mechanism comprises: a hydraulic jack including a cylinder body fixed to said upper beam and including a jack-movable plunger element by which the cage is cable-suspended via downwardly reacting abutment with the hitch plate; a hydraulic circuit including a reservoir, a pump with inlet connection to said reservoir and outlet connection to said cylinder, and a bleed connection from said cylinder to said reservoir; and jack-operated feedback-control means including a control valve in said bleed connection, said feedback-control means also including a floor-level actuated probe, said probe being operative to sense a difference between level of the elevator-car floor and the level of the particular structure floor at which the elevator cage has been controlled to stop, and the sensed difference being operative to correctively operate said jack until reduction of said difference to substantially zero.

2. The improvement of claim 1, in which said pump is driven by an electric motor carried by the elevator cage.

3. The improvement of claim 1, wherein a control connection for the sheave-motor drive includes an additional control connection to said jack for determining a reset positioning of said jack within the stroke of said plunger element and during periods of sheave-motor drive.

4. The improvement of claim 3, wherein the reset positioning of said jack is to a predetermined reference position near the upper limit of said lost-motion.

5. The improvement of claim 1, in which a stopping of the sheave-motor drive is preset to occur substantially at but always slightly above the level of a structure floor, and in which further feedback-control means is operative to reset said jack to fully extended position.

6. The improvement of claim 1, in which said jack is hydraulic and includes a source of pressurized fluid for operation thereof, and means including an interlock to the sheave-motor control for controlling supply of pressure fluid at said jack to restore the reset position of said jack.

* * * * *